US007779566B2

(12) United States Patent
Kassouni

(10) Patent No.: US 7,779,566 B2
(45) Date of Patent: Aug. 24, 2010

(54) WIRE MARKER

(76) Inventor: Van Kassouni, 6271 Capitan, Grand Rapids, MI (US) 49546

( * ) Notice: Subject to any disclaimer, the term of this patent is extended or adjusted under 35 U.S.C. 154(b) by 33 days.

(21) Appl. No.: 12/027,398

(22) Filed: Feb. 7, 2008

(65) Prior Publication Data

US 2009/0199443 A1 Aug. 13, 2009

(51) Int. Cl.
*G09F 3/00* (2006.01)

(52) U.S. Cl. ..... 40/316; 40/308

(58) Field of Classification Search ..... 40/308, 40/316; 116/209

See application file for complete search history.

(56) References Cited

U.S. PATENT DOCUMENTS 1,241,302 A * 9/1917 Taylor ..... 40/667
3,785,337 A 1/1974 Flowerday
3,964,197 A * 6/1976 Tucker et al. ..... 40/584
4,265,195 A 5/1981 Higgins
4,742,796 A 5/1988 Halsey

* cited by examiner

*Primary Examiner*—Joanne Silbermann
(74) *Attorney, Agent, or Firm*—Van Dyke, Gardner, Linn & Burkhart LLP

(57) ABSTRACT

A wire marker that can be removably attached to a wire, such as an aerial or fence wire. The marker can have a base and an integral deformable arm having a first and second distal tip. The tips can have catches on the same side and a catch on the opposite side oriented between the catches and offset along a longitudinal axis between the catches. The offset can be distal or proximal to the base on the longitudinal axis between the catches, and the offset can be configured to accommodate a diameter of a fence wire. The marker base can be substantially triangular in shape and made of injection molded plastic and colored to make it visible relative to its surroundings, such as international orange.

16 Claims, 5 Drawing Sheets

WIRE MARKER

CROSS REFERENCE TO RELATED APPLICATIONS

None

BACKGROUND OF THE INVENTION

1. Field of the Invention

The present invention relates generally to visual indicators or markers and, more particularly, to indicators or markers that can be removably attached to a wire, such as an aerial wire or fence wire.

2. Related Art

Indicators or markers designed for attachment to aerial wires or fence wires are known in the art, but are typically cumbersome and costly. To comply with state regulations, and in view of the increase in recreational activities such as snowmobiling and trail riding and even small personal aircraft, the need for inexpensive wire markers that provide ease of use and resistance to seasonal climate variations is demonstrated.

Prior art indicators and markers have included thick blocks of insulating materials with a wire-holding groove provided for attachment directly to the wire fence, as is disclosed in U.S. Pat. No. 4,265,195 to Higgins. The insulated block provides a means for attaching a hanging streamer to serve as the warning indicator. This type of block device is costly to manufacture and install and has the additional disadvantage of adding a weight load to a wire.

Hanging tabs or streamers are also known in the art, such as U.S. Pat. No. 4,742,796 to Halsey. The Halsey device includes a brightly colored cloth-like streamer hanging from a tab with a slit opening from the outer edge of the tab to provide a mounting location to the wire fence. Unfortunately, such devices are not durable, deteriorate over long term use, and do not stay in a fixed position on the wire. Also, U.S. Pat. No. 3,785,337 to Flowerday discloses a wire marker that has an integral strap on the base indicator, but the strap does not prevent lateral movement along the wire.

Thus, while various types of warning indicators and markers are known, none have demonstrated the improvements and abilities of the current design. The improvements needed, which are encompassed in the current design, include lower cost to manufacture, ease of installation, flexible application, and durability.

SUMMARY OF THE INVENTION

The present invention relates generally to visual indicators or markers and, more particularly, to indicators or markers that can be removably attached to a wire, such as an aerial wire or fence wire.

In one embodiment, the wire marker has a base; a deformable arm integral with the base; the arm having a first and second distal tip and a first side and second side; the first tip having a first catch and the second tip having a second catch, both on the first side and in bilateral symmetry; and a third catch on the second side oriented between the first and second catch and offset along a longitudinal axis between the first and second catch.

Other features of the present invention can include the offset as distal or proximal to the base on the longitudinal axis between the first and second catch, and the offset can be configured to accommodate a diameter of a fence wire. The marker base can be substantially triangular in shape. The marker can be made of injection molded plastic and colored to make it visible relative to its surroundings, such as international orange.

Optional features of the present invention may also include apertures to allow passage of a fastener; for example, to allow the marker to be nailed to a tree.

In use, the marker's deformable arm allows for a wire to be interwoven between the first distal arm, the base, and the second distal arm. The catches prevent the marker from being displaced from the wire while also prevent lateral movement along the wire.

Other features of the present invention will become more apparent to persons having ordinary skill in the art to which the present invention pertains from the following description and claims.

BRIEF DESCRIPTION OF THE FIGURES

The foregoing features, as well as other features, will become apparent with reference to the description and figures below, in which like numerals represent like elements, and in which.

DETAILED DESCRIPTION OF THE INVENTION

The present invention relates generally to visual indicators or markers and, more particularly, to indicators or markers that can be removably attached to a wire, such as an aerial wire or fence wire. The present invention provides a visible wire marking device having multiple applications and affording ease of installation, durability to withstand weather and climate conditions over long term use, and the ability to stay in a fixed position on the fence. This system is relatively inexpensive to manufacture as compared with prior art marking devices of similar utility. The marking device can be made of plastic or other semi-rigid materials, injection molded into various geometric shapes so as to allow for the creation of a one piece unit with integrated attachment means. Various colors may also be used to make the marker easily visible in relation to its surroundings, such as orange.

In an additional embodiment, the abutments are bifurcated and cored, which allows the wire to be snapped in place into the abutments, providing additional attachment stability. In another embodiment, the abutments are formed into an L-shape, which can be snapped down over the wire, thereby providing increased stability.

Advantages of the present invention over the prior art are that the catches can be configured to accommodate a variety of applications to account for wire thickness and composition; external fasteners may also be used, and the marker is durable and stable while in use.

Figure 1:
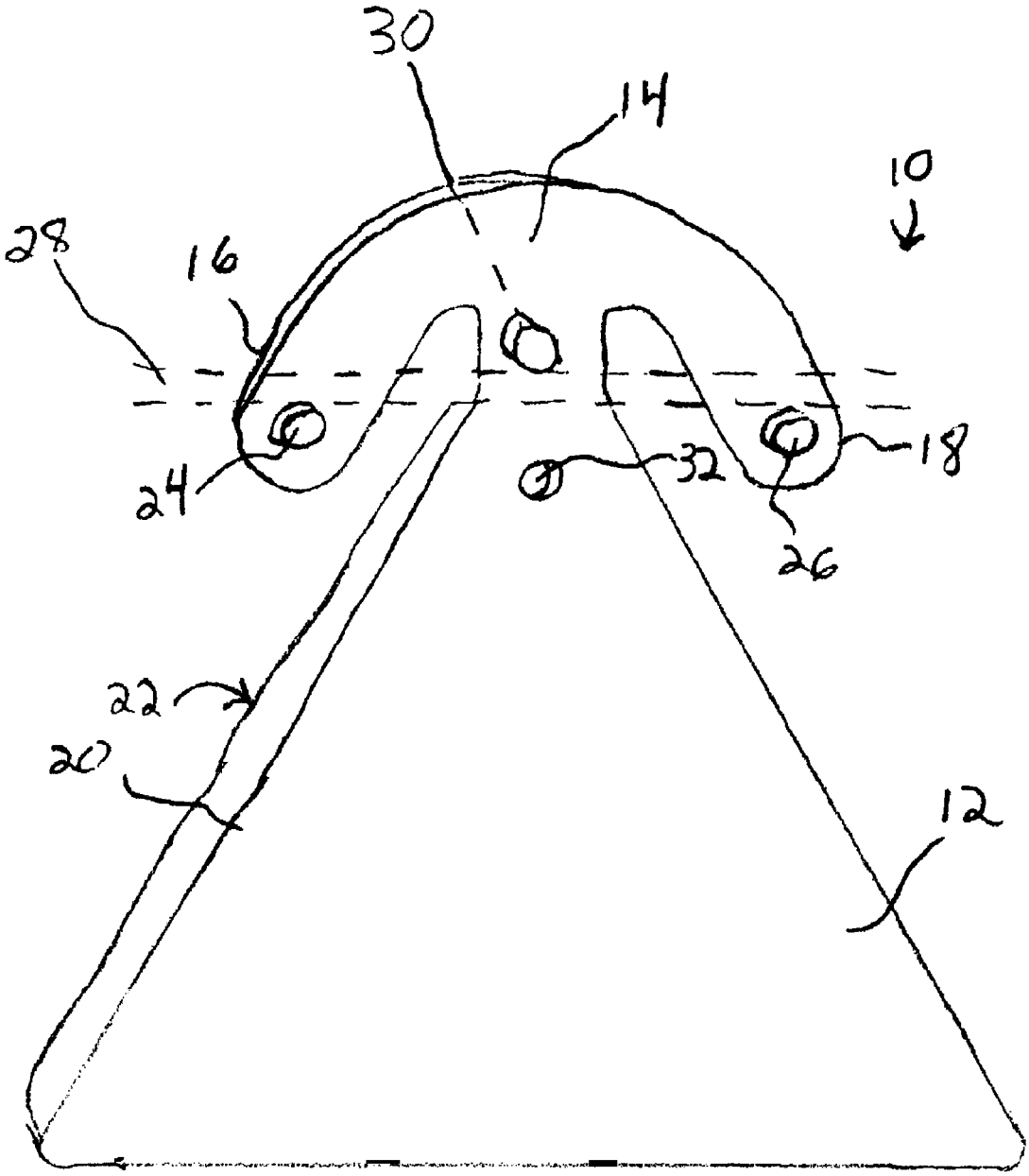
FIG. 1 is a perspective view of a first side of a first embodiment of the present invention wire marker.
Figure 2:
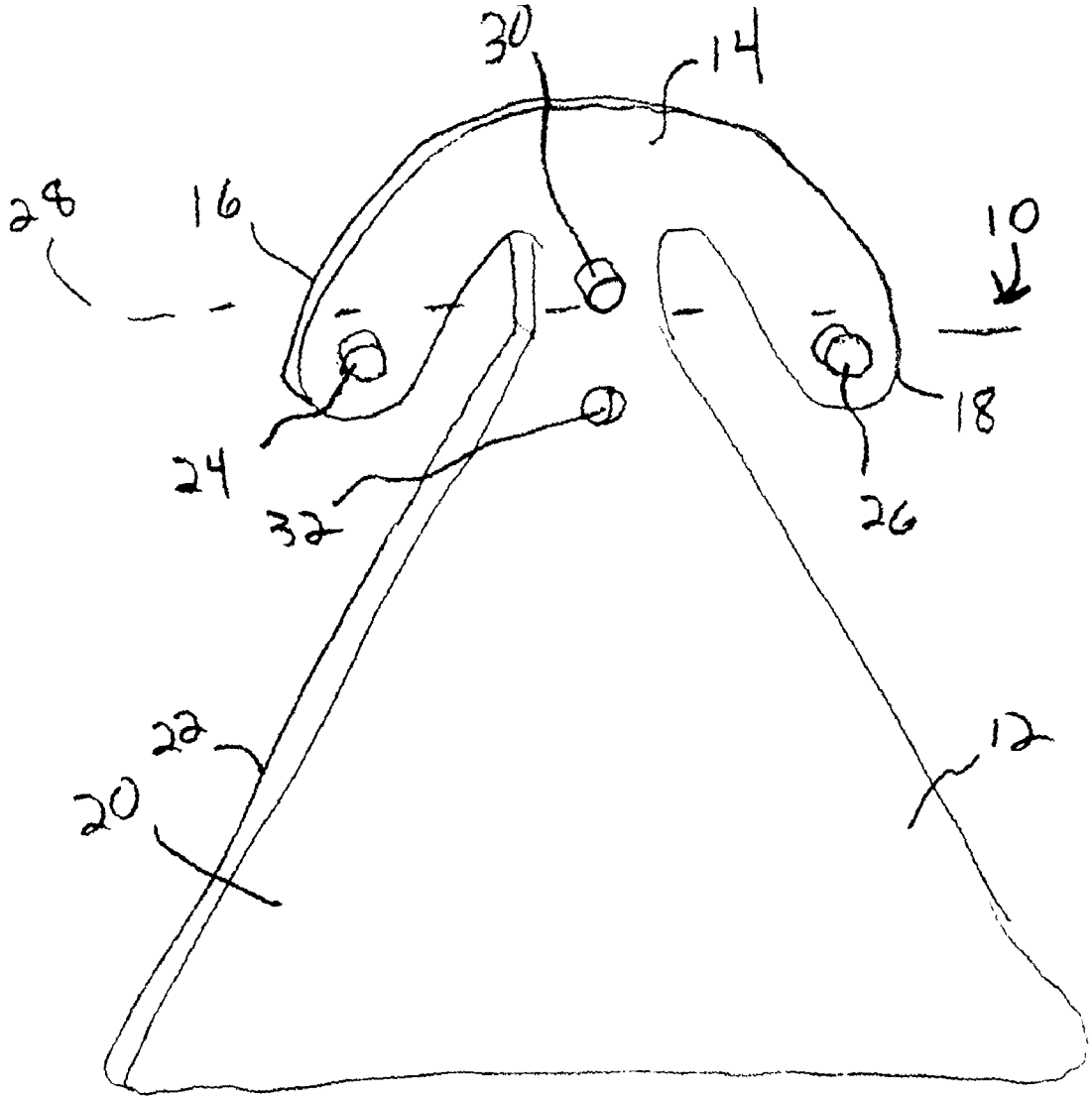
FIG. 2 is a perspective view of a second side of a first embodiment of the present invention wire marker.
Figure 3:
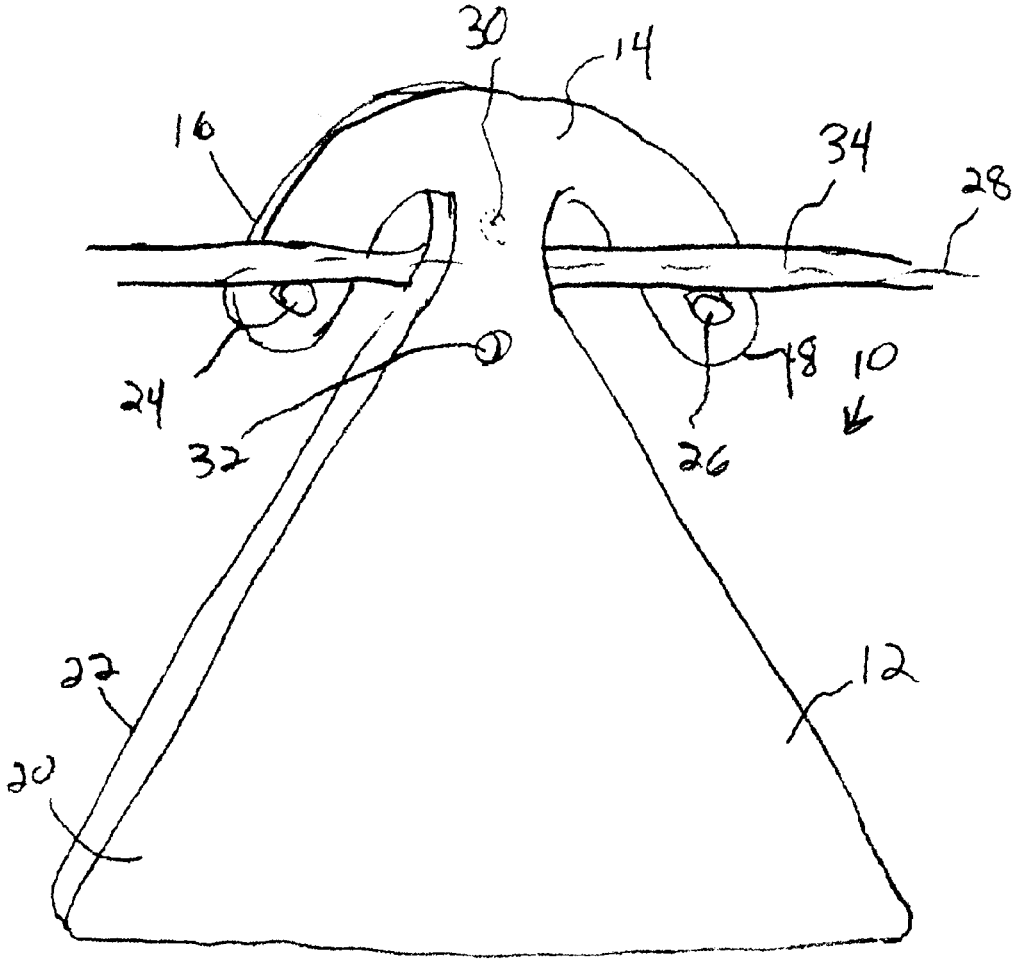
FIG. 3 is a perspective view of the first side of a first embodiment of the present invention wire marker in use.
Figure 4:
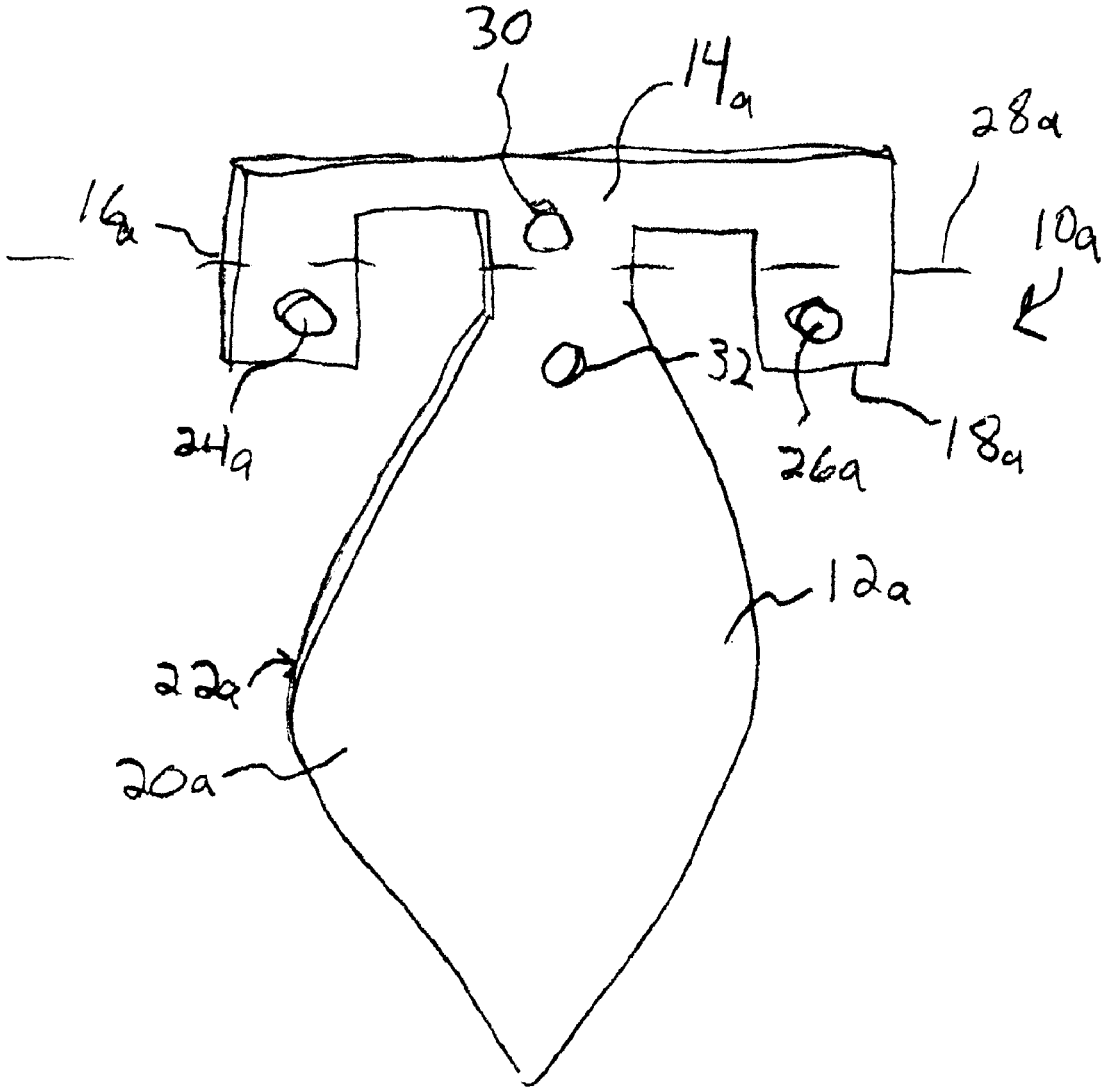
FIG. 4 is a perspective view of a first side of a second embodiment of the present invention wire marker.

Referring now to the figures, FIGS. 1-3 show the present invention from both sides and in use. FIG. 4 shows an alternate embodiment of the present invention to illustrate that other geometric shapes are possible while still demonstrating the objects of the invention.

Specifically, the figures show a wire marker generally indicated at 10. Marker 10 has a base 12 that can be formed in a variety of shapes and sizes and limited only by material and engineering constraints. Such constraints may include limitations for injection molding if marker 10 is manufactured in injected molded plastic. Integral with base 12 is a deformable arm 14 having a first distal tip 16 and second distal tip 18 and a first side 20 and second side 22.

As illustrated, and not by way of limitation, distal tips 16 and 18 can have catch 24 and catch 26 respectively. These catches can be of various shapes and sizes of raised surfaces on the distal tips to allow securing marker 10 to a wire, such as is shown in FIG. 3. As is shown in the figures, the invention is best practiced with the distal tips in a generally downward slope arch, leaving space to interweave a wire in from the first distal tip 16, around base 12, and back through distal tip 18. Also, catches 24 and 26 should be along a longitudinal line 28 and maintaining bilateral symmetry, though this is not critical. In use, a wire would follow the path of longitudinal line 28.

Figure 1A:
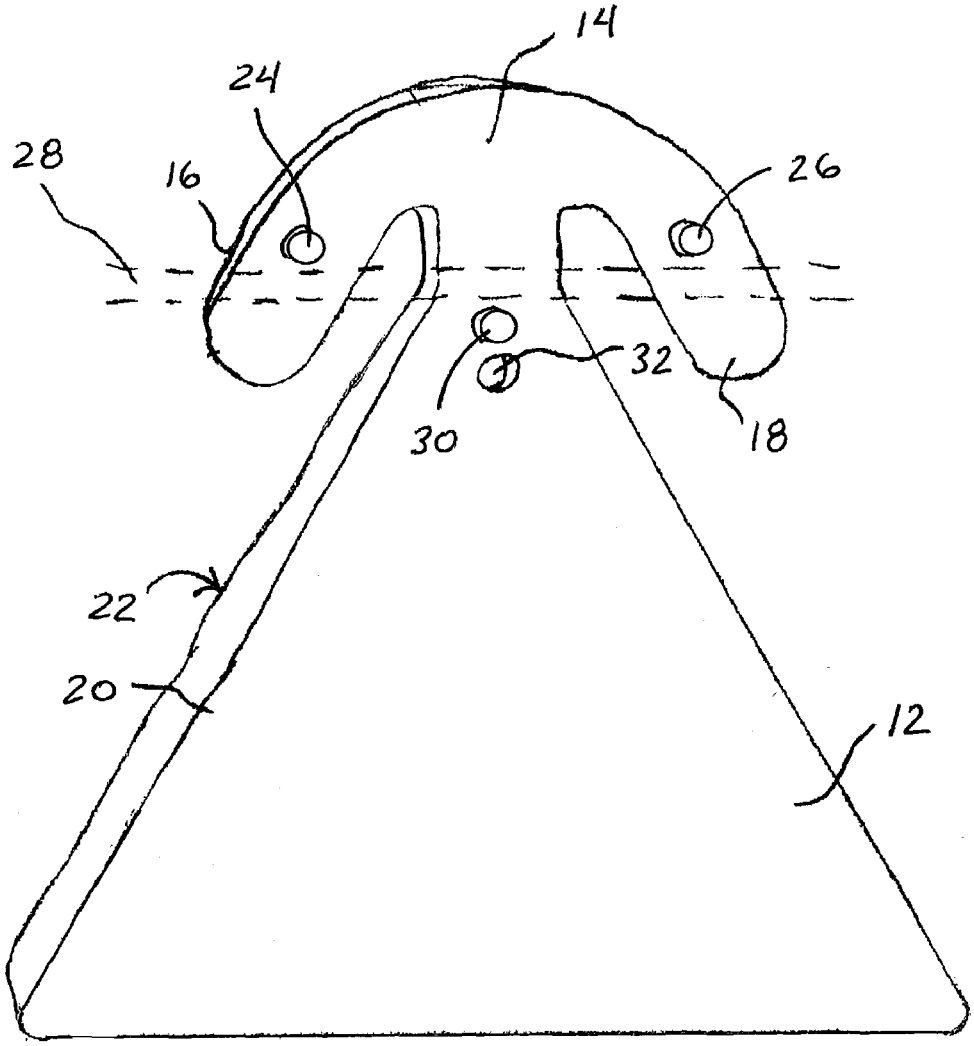
FIG. 1A is a perspective view of a first side of the first embodiment of the present invention wire marker, with the catch 30 being proximal to the base.

As illustrated, a third catch 30 can be placed on side 22 of marker 10. Third catch 30 should be oriented between catches 24 and 26 and on opposing sides of marker 10. Further, catch 30 should be offset from longitudinal line 28. This offset can be determined by the diameter of the wire to be marked or as dictated by sound engineering practices. Catch 30's offset to longitudinal line can also be distal to base 12 (as shown in FIGS. 1, 2 and 3) or proximal to 12 (FIG. 1A).

Optional features of the present invention can include an aperture 32 to allow passage of a fastener. For example, aperture 32 may be useful when marker 10 needs to be nailed to an object. Also, base 12 is shown in FIGS. 1-3 as substantially triangular in shape. Nevertheless, as shown in FIG. 4, base 12*a* can include a variety of shapes and still achieve the objects of the invention. The same is true for deformable arm 14*a*, which is shown as a substantially "L" shape in FIG. 4.

In use, as is shown in FIG. 3, marker 10 is installed on a wire 34. Placement of marker 10 is by deforming distal tips 16 and 18 so that as marker 10 is lowered onto wire 34, distal tips 16 and 18 "wrap" around wire 34. As shown, marker 10 is lowered until wire 34 rests against catch 30. Distal tips 16 and 18 are then aligned with wire 34 and released so that marker 10 is secured on wire 34.

The foregoing invention has been described in accordance with the relevant legal standards; thus, the description is exemplary rather than limiting in nature. Variations and modifications to the disclosed embodiment may become apparent to those skilled in the art and fall within the scope of the invention. Accordingly, the scope of legal protection afforded this invention can only be determined by studying the following claims.

I claim:

1. A wire marker for attaching to a wire, said wire marker comprising:

a base;

a deformable arm, wherein the deformable arm is formed integrally with the base, and wherein the arm has a first side and a second side opposite the first side;

wherein the arm comprises a base arm portion extending outwardly from the base and a first distal arm portion extending from a distal end of the base arm portion and a second distal arm portion extending from the distal end of the base arm portion;

wherein the first and second distal arm portions extend from the distal end of the base arm portion and extend at least partially towards the base so as to extend at least partially along the base arm portion;

wherein the first distal arm portion has a first catch extending from the first side and the second distal arm portion has a second catch extending from the first side; and wherein the base arm portion has a third catch extending from the second side and oriented between the first catch and the second catch and offset along a longitudinal axis between the first catch and the second catch.

2. The wire marker of claim 1, wherein the offset is distal to the base on the longitudinal axis between the first catch and the second catch.

3. The wire marker of claim 1, wherein the offset is proximal to the base on the longitudinal axis between the first catch and the second catch.

4. The wire marker of claim 1, wherein the offset is spaced to accommodate a diameter of a fence wire.

5. The wire marker of claim 1, wherein the marker is made of injected molded plastic.

6. The wire marker of claim 1, wherein the marker is colored to set the marker apart from its surroundings.

7. The wire marker of claim 6, wherein the color is orange.

8. The wire marker of claim 1, further comprising an aperture for allowing passage of a fastener.

9. The wire marker of claim 1, wherein the base is substantially triangular in shape.

10. The wire marker of claim 1, wherein the first and second distal arm portions comprise elastically deformable distal arm portions extending in generally opposite directions from the distal end of the base arm portion and the first, second and third catches are configured non-collinearly so as to permit a fence wire to be woven between the catches.

11. The wire marker of claim 1, wherein the distal end portions of the deformable arms are formed in an L-shape to allow for passage of wire.

12. The wire marker of claim 1, wherein the arm is configured such that a wire to which the wire marker is attached is routed along the first side of the first and second distal arm portions and along the second side of the base arm portion.

13. The wire marker of claim 12, wherein the arm is configured such that the wire to which the wire marker is attached is routed above the first and second catches and below the third catch.

14. The wire marker of claim 12, wherein the wire marker is configured such that the base is disposed below the arm when the wire marker is attached to a wire.

15. The wire marker of claim 1, wherein the arm is configured such that the wire to which the wire marker is attached is routed above the first and second catches and below the third catch.

16. The wire marker of claim 1, wherein the wire marker is configured such that the base is disposed below the arm when the wire marker is attached to a wire.

* * * * *